United States Patent [19]

Lubavs

[11] 4,266,916

[45] May 12, 1981

[54] MOBILE BLOCK PRODUCTION PLANT

[76] Inventor: Arnold A. Lubavs, 5331 NW. 57th Ave. "N", Des Moines, Iowa 50131

[21] Appl. No.: 121,497

[22] Filed: Feb. 14, 1980

[51] Int. Cl.[3] ..... B28B 15/00

[52] U.S. Cl. ..... 425/62; 425/88

[58] Field of Search ..... 425/62, 88

[56] References Cited

U.S. PATENT DOCUMENTS

| | | | |
|---|---|---|---|
| 3,142,105 | 7/1964 | Weir et al. | 425/62 |
| 3,181,482 | 5/1965 | Heth et al. | 425/62 |
| 3,525,131 | 8/1970 | Schneider et al. | 425/62 X |
| 3,659,979 | 5/1972 | Schneider et al. | 425/62 |
| 4,207,041 | 6/1980 | Kampiziones | 425/62 |

*Primary Examiner*—J. Howard Flint, Jr.

*Attorney, Agent, or Firm*—Zarley, McKee, Thomte, Voorhees & Sease

[57] ABSTRACT

A mobile cement block production plant. The plant is comprised of a mobile block producing station mounted on the bed of a vehicle and a mobile block curing station, independently movable with respect to the block producing station, with the curing station comprised of a trailer having a bed, and mounted on the trailer bed are at least two block curing kilns for steam curing of blocks, each of the kilns being capable of independent function with respect to the other, and each of the kilns having an associated extendible canopy which may be extended from kilns toward the block producing station so that blocks may be continuously manufactured and cured, a canopy from one extendible station being used for steam curing of blocks while block previously steam cured in the other may be loaded.

6 Claims, 5 Drawing Figures

MOBILE BLOCK PRODUCTION PLANT

BACKGROUND OF THE INVENTION

This invention relates to a mobile block producing plant. It is primarily designed to be a wholly self-contained mobile unit for manufacturing and curing cement blocks at remote places.

When construction projects are undertaken at remote areas, not conveniently near sources of power or, for that matter, industrial manufacturing facilities, such projects often are considerably delayed pending transport of blocks and setting up of temporary power stations.

According to this invention, a mobile, wholly self-contained manufacturing facility for blocks is provided. The unit is self-contained, not only from the standpoint of block producing and curing facilities, but also from a mode of power standpoint. Accordingly, all that need be done for building in remote areas is to transport the mobile unit to the remote area and providing that raw materials such as cement and sand are available, the unit can be run directly at the remote building site for production of blocks.

Accordingly a primary object of this invention is to provide a self-contained mobile factory for the production of cement blocks, or other structural building materials of a similar nature which can be moved to a remote building area and thereafter used as a wholly self-contained block production facility.

Another object of this invention is to provide a wholly self-contained mobile block producing and curing factory which is efficient and economical of construction and use.

Yet a further object of the invention is to provide a mobile factory which has an independently mobile block producing station and an independently mobile block curing station, with the block curing station itself having two independently operable block curing kilns, each having an extendible canopy so that while block is being cured in one canopy covered area, block previously cured in the other may be loaded for use. Thus, the unit is capable of continuous operation.

The method and means of accomplishing each of the stated objectives will become apparent from the detailed description of the invention which follows hereinafter.

DETAILED DESCRIPTION OF THE INVENTION

Figure 1:
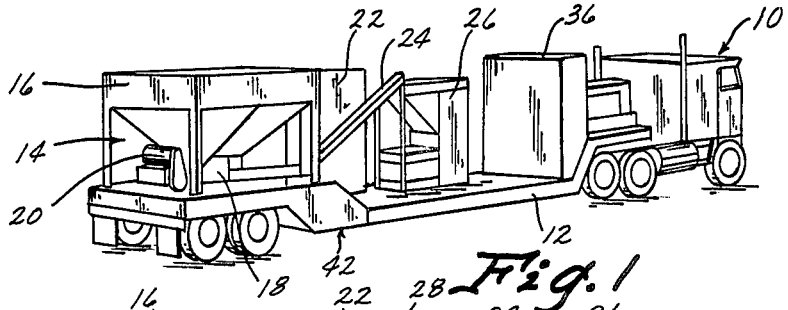
FIG. 1 is a perspective view of the block production van.

Looking first at FIG. 1, the mobile block producing station is comprised of a vehicle 10, having a bed or platform 12, which in turn has the hereafter described components mounted thereon. The vehicle 10 is of conventional size and dimensions for travel and use on a highway system. Before describing the individual components mounted on the vehicle platform 12, by way of explanation, each of the individual components are well known and therefore, for example, detailed structure of, for example, a concrete mixer, as well as the other components, has not been illustrated or will not be provided herein. Such devices and their independent operation, apart from their relationship in the present invention, are well known and need not be described in detail for one skilled in the art.

Figure 2:
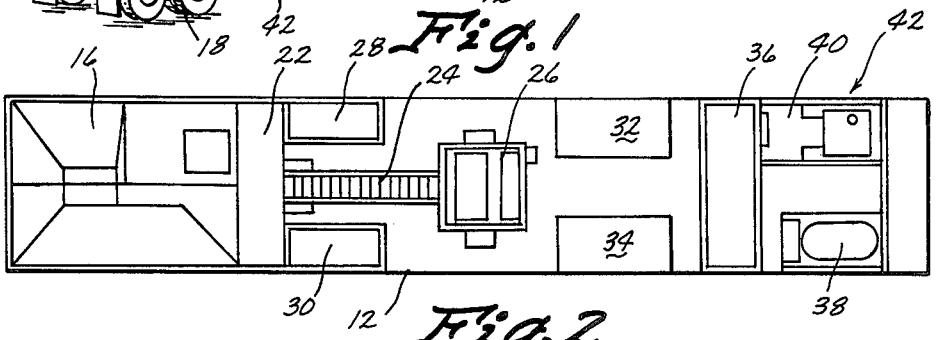
FIG. 2 is a plan view of the block production van of FIG. 1.

Looking now at FIG. 1 in association with FIG. 2, it can be seen that mounted near the rear of platform 12 is a continuous flow mixer unit 14. The mixer unit 14 is itself comprised of an upper hopper portion 16 for loading of cement, sand and stone and feeding those into a lower auger mixing area 18 which is powered by an electrically driven motor 20. The mixing unit has an associated water tank 22. Thus, sand, cement, gravel and water may be metered into the mixing area 18 and mixed therein to provide wet concrete mix. Such small portable mixing units are well known and a variety of such units are capable of being mounted on the vehicle platform 12 for use. One example which has satisfactorily operated is a continuous mixer sold by the Kent Concrete Equipment Company of Brampton, Ontario, Canada, under the trademark "The Kent Flomaster." The unit is described including its operation and specifications, in a brochure entitled The Kent Flomaster Continuous Mixer which is available from the manufacturer at the address listed herein, and which is incorporated herein by reference.

Moving forward from the continuous flow mixing unit 14, it can be seen that a conveyor 24 extends from mixer 14 to block machine 26. The conveyor 24 can, for example, be an 18 inch wide belt over rollers and is used to convey mixed concrete from the mixing unit 14 to the block making machine 26. Such conveyors are well known and therefore a detailed description will not be given herein. The conveyed wet mixed material is dropped from the top of conveyor 24 into the upper portion of block machine 26. Block machine 26 likewise is an individually known component. It is powered by an electric motor, not specifically depicted herein, and molds wet concrete mix into concrete and/or cement blocks. Numerous block making machines can be employed, the only important criteria being that they are small enough to mount on the bed 12. One satisfactory block making machine which can be used herein is sold by the previously mentioned Kent Concrete Equipment Company, Division of Besser Canada, Limited, of 387 Orenda Road, Brampton, Ontario, L6T, 1G4, Canada, under the trademark KENT-ONE Plain Pallet Block Machine. Such a machine has the capability of interchangeable molds for producing blocks of varying size. Since this individual component is known in the art, a detailed description need not be given herein.

Looking further at FIGS. 1 and 2, it can be seen that in addition to the components mentioned herein, storage pallet racks 28, 30, can be mounted on the available space on platform 12 for storing of empty pallets. These pallet storage racks are removably attached to platform 12, so that they may be removed therefrom and used in the production station, as shown in positions 32 and 34.

Forward of the mixer 26 and forward of a permanently mounted storage bin 36 is an air compressor 38 and an electrical generator 40 which are used in conjunction with the operation of block machine 26. Again, the operation of the air compressor 38 and the electric generator 40 in association with block machine 26 is well known and need not be described in detail herein.

It can therefore be seen that the block producing station is mobile, and wholly self-contained on the platform of a vehicle which may be transported conveniently to remote areas.

Figure 3:
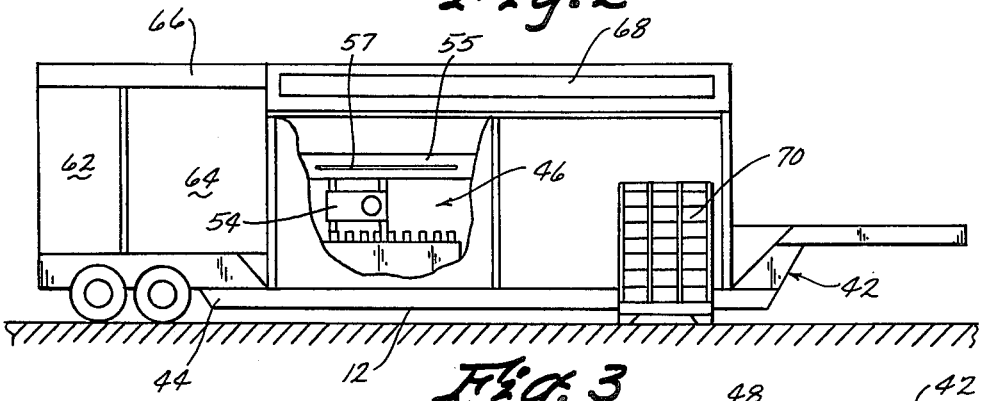
FIG. 3 is an elevated side view, with parts broken away, of the block curing station.
Figure 4:
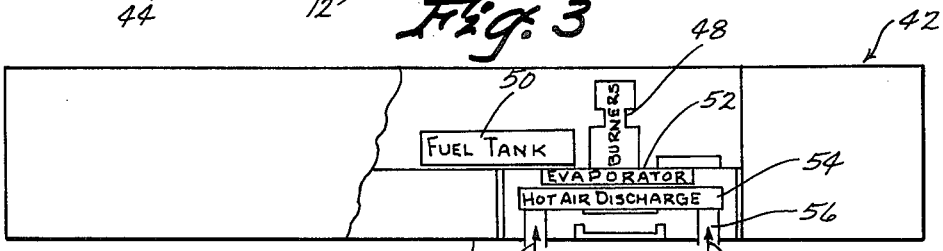
FIG. 4 is a plan view of the block curing station of FIG. 3.

Turning now to a description of the block curing station as depicted in FIGS. 3 and 4, it can be seen that a trailer 42 is shown. Mounted on the bed 44 are the following components: At approximately the mid-point of trailer bed 44 are mounted two individually operable block curing kilns (only one is shown for purposes of illustration, since both are identical) 46. But it is understood that at least two such kilns are mounted on said trailer. The kilns are also individually of known construction and therefore have been illustrated herein only schematically. They are comprised of burners 48 which burn fuel from fuel tank 50 which in turn heats water in evaporator 52 and an associated blower 54. Hot air from blower 54 enters conduit 55 and is blown outwardly in a horizontal fashion through slit 57. Return intakes 38 and 60 allow recirculation of hot air which has already passed over the curing blocks.

Each kiln may be a direct fired fuel oil burner of the type sold by Johnson Gas Appliance Company of Cedar Rapids, Iowa, described in a brochure entitled Direct Fired Curing System for Concrete Masonry Units, described in their brochure CS-7-76-TM, which is incorporated herein by reference. Basically, each kiln operates in the following manner. The burners 48 located outside the back of the kiln fire directly into a specially designed stainless steel vaporizing tank inside of the kiln. Water is boiled in the vaporizing tank depicted as evaporator 52, and the products of combustion and steam are discharged from the vaporizing tank in the form of steam and products of combustion which pass through conduit 55 as previously discussed.

The remaining portion of trailer bed 44, other than that utilized for the two individually operable kilns 46, may be arranged and compartmentalized in any manner convenient for the operator usage as desired. As shown in FIG. 3, at the rear of the curing station are compartments 62, 64 and 66 for storage. Water tank 68 is mounted above kilns 46 to provide the water which is metered into the kiln via evaporator 52 to provide the steam which passes out conduit 55.

Loading racks and pallets such as rack 70 may be stored in the previously referred to compartments.

Each kiln 46 has an associated extendible canopy which may be stored in compartment 66. The canopy must be a heat resistant material and resistant to tears in order that it will effectively retain the steam discharged from kilns 46. The canopy may be supported by collapsible tent pole-like structures not specifically depicted herein. The canopy is extended from the side of the trailer laterally so that it will provide an effective enclosure for steam discharged from kiln 46 via conduit 55 and slit 57.

Figure 5:
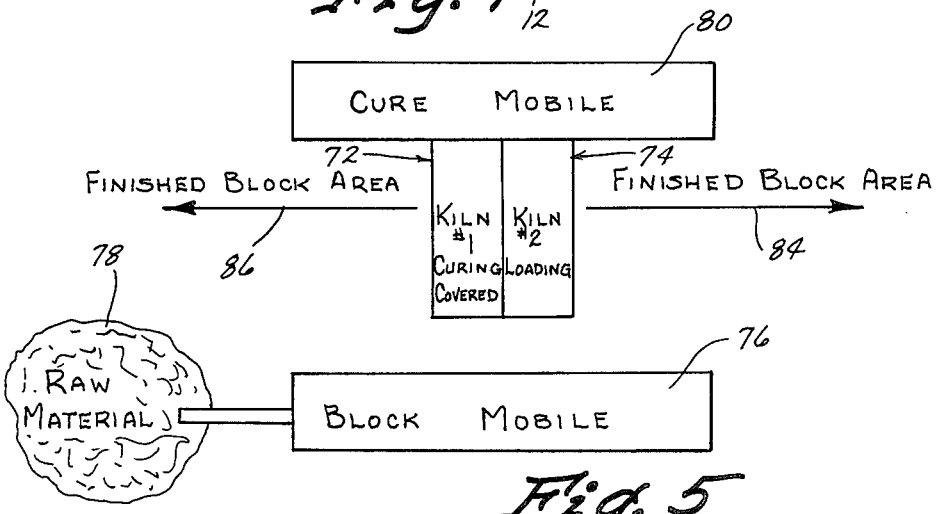
FIG. 5 is a schematic layout illustrating the positions and relationships of the block manufacturing station and the block curing station during use for production of concrete blocks at a remote area.

Looking now at FIG. 5, it can be seen that the canopies 72 and 74 are schematically depicted in extended position. This extended position is their ready-use position.

The operation of the complete mobile factory may be demonstrated with respect to the layout shown in FIG. 5. The block mobile of FIG. 1 is placed in position as depicted at 76. Raw material is fed in as depicted at 78. The raw materials are mixed in the mixer 14 conveyed by conveyor 24 to block machine 26 and blocks made therein. Blocks leaving block machine 26 are placed on pallets, and/or racks and are fresh blocks ready for curing.

Again, as depicted in FIG. 5, the cure mobile is parked in side-by-side, spaced apart relationship parallel to the block machine. In the drawing of FIG. 5, the cure mobile and/or station is depicted at 80. Fresh blocks from the block machine are placed on racks, such as the racks shown at 70, and placed, for example, in the canopy covered area for kiln 1 depicted at 72. The kiln 46 is activated and curing steam pushed into the canopy covered area to cure the blocks in the covered kiln area 72. While those blocks in kiln covered area 72 are being cured, additional fresh blocks are loaded into kiln curing area 74 in the same manner previously described. Curing may take from six to ten hours. Often by the time racks are filled in the second kiln area 74 and its identical kiln 46 activated, the first kiln can be shut down and the blocks are cured, ready for removal to finish block area depicted at arrow 86. Simultaneously additional blocks can be manufactured by the block machine 26 and those transferred into the first kiln area 72 to replace the blocks removed at 86. By the time this opertion is completed, the blocks in the second kiln area 74 are cured and ready for removal at 84. During this operation, the first kiln 46 is again activated to cure the now freshly positioned blocks. It thus can be seen that the operation can be continuously run, since each kiln operates independent of the other and one can be shut down for removal and transportion of cured blocks while the other is curing freshly made blocks. It is therefore extremely important to the invention that two independently operable kilns be mounted on the curing station. Any other arrangement will necessitate holding time which prevents a continuous operation.

After all needed blocks are made, the canopies 72 and 74 are taken down, their tent-like supporting pole structures taken down and stored in the previously referred to compartment 66 along with the canopies. The unit can then be moved to another station for producing further blocks.

It can therefore be seen that an efficient, cheap and economical, fully mobile plant for the manufacture of cement blocks or the like, has been provided.

What is claimed is:

1. A mobile plant for production of concrete blocks, comprising:

a mobile block production station comprised of a vehicle having a bed, and mounted on said bed, a raw materials mixer, and a block making machine, and a conveyor extending from said mixer to said block machine to convey readly mixed concrete from said mixer to said block machine, and a mobile curing station, independently movable with respect to said block producing station, comprised of a trailer having a bed, and mounted on said bed at least two block curing kilns, each of said kilns being capable of independent function with respect to the other, for steam curing of blocks, each of said kilns having an associated extendible canopy which may be extended from said kiln towards said block producing station so that fresh made blocks may be placed therein for curing by steam.

2. The device of claim 1 wherein the curing station is mounted on a movable trailer.

3. The device of claim 2 wherein said trailer has a plurality of storage compartments thereon.

4. The device of claim 1 wherein said canopies are special heat resistant materials which are also moisture proof.

5. The device of claim 1 wherein the bed of said mobile block producing station is a double drop low-boy deck.

6. The device of claim 2 wherein said trailer of said curing station is a double drop low-boy deck.

* * * * *